US007198496B2

(12) United States Patent
Yamamoto

(10) Patent No.: US 7,198,496 B2
(45) Date of Patent: Apr. 3, 2007

(54) LEVER TYPE CONNECTOR

(75) Inventor: Tohru Yamamoto, Kanagawa (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 0 days.

(21) Appl. No.: 11/423,241

(22) Filed: Jun. 9, 2006

(65) Prior Publication Data

US 2006/0281350 A1 Dec. 14, 2006

(30) Foreign Application Priority Data

Jun. 9, 2005 (JP) ..... 2005-169887

(51) Int. Cl.
*H01R 13/62* (2006.01)

(52) U.S. Cl. ..... 439/157; 439/347

(58) Field of Classification Search ..... 439/157, 439/153, 160, 372, 310, 347
See application file for complete search history.

(56) References Cited

U.S. PATENT DOCUMENTS

2001/0019908 A1* 9/2001 Zweigle ..... 439/157
2003/0022539 A1* 1/2003 Takahashi ..... 439/157
2003/0054681 A1* 3/2003 Hatagishi et al. ..... 439/157
2003/0199185 A1* 10/2003 Fujii et al. ..... 439/157
2005/0026484 A1* 2/2005 Demuth ..... 439/157

FOREIGN PATENT DOCUMENTS

JP 10-074561 3/1998

* cited by examiner

*Primary Examiner*—Hien Vu
(74) *Attorney, Agent, or Firm*—Barley Snyder LLC

(57) ABSTRACT

A lever type connector includes a housing having recessed rail members with first and second locking recesses. A lever pivotable between an initial position and a final position is mounted on the housing so that the lever is either pushed over toward a first side or a second side of the housing in the initial position. A wire cover has sliding claws that are received in the recessed rail members to slideably mount the wire cover to the housing. The sliding claws have locking projections that engage either the first projections on the first side of the housing or the second projections on the second side of the housing to lock the wire cover to the housing. A lock preventing member is arranged between the first locking recesses and the second locking recesses and prevents the wire cover from being locked to the housing in an incorrect orientation.

17 Claims, 8 Drawing Sheets

LEVER TYPE CONNECTOR

FIELD OF THE INVENTION

The invention generally relates to a lever type connector for reducing a mating force between the lever type connector and a mating connector. More particularly, the invention relates to a lever type connector having a lever pivotable between an initial position and a final position and a wire cover having an electrical wire lead-out opening that leads out electrical wires from either a first side or a second side of a housing of the lever type connector.

BACKGROUND OF THE INVENTION

Lever type connectors for reducing the mating force between a lever type connector and a mating connector are well known. FIGS. 8A–8B show an example of a conventional lever type connector 101 (see JP10-74561A). As shown in FIGS. 8A–8B, the lever type connector 101 comprises a housing 110. A plurality of contact accommodating openings 111 are formed in the housing 110. Contacts (not shown) having electrical wires (not shown) connected thereto are provided in the contact accommodating openings 111. Contact insertion openings 111*a* are formed in a mating surface of the housing 110 and communicate with the contact accommodating openings 111. Engaging projection members 112 are formed on an upper surface of the housing 110 in a right-side rear corner portion thereof and on an undersurface of the housing 110 in a left-side rear corner portion thereof. An inverted-insertion preventing piece 113 is formed so as to protrude from a first side surface of the housing 110. Projections 114 are provided above and below the inverted-insertion preventing piece 113 of the housing 110 and on a side surface opposite from a side on which the inverted-insertion preventing piece 113 is provided.

A wire cover 120 accommodates the housing 110. The wire cover 120 comprises a cover main body 121 having a housing accommodating cavity 122 on an inside thereof. The housing accommodating cavity 122 opens on a first side surface of the cover main body 121. An electrical wire lead-out opening 123 is provided in the cover main body 121 and is continuous with the housing accommodating cavity 122. The electrical wire lead-out opening 123 opens on a first side surface of the cover main body 121. A flexible locking piece 124 is provided at a right end portion of an upper surface of the cover main body 121. A locking opening 124*a* that engages with one of the engaging projection members 112 is formed in the locking piece 124. An engaging groove 125 that can engage with the engaging projection member 112 is formed in a bottom surface of the cover main body 121 opposing the locking piece 124. A plurality of contact insertion openings 126 is formed in a mating surface of the housing main body 121.

A lever 130 is attached to the wire cover 120 in a pivotable manner. The lever 130 is substantially U-shaped and comprises a pair of legs 131 and a linking member 132 that connects the legs 131. Attachment openings 133 are formed in base members of the legs 131. The attachment openings 133 are fitted over shaft members 128 provided on the upper surface and undersurface of the cover main body 121 of the wire cover 120 so that the lever 130 is mounted in a manner allowing the pivoting of the lever 130 between an initial position and a final position. The lever 130 is maintained in the initial position shown in FIGS. 8A & 8B by holding projections 129 provided on the wire cover 120 that enter holding openings 134 formed in the legs 131. The lever 130 is maintained in the final position by holding projections 127 provided on the wire cover 120 that enter holding openings 135 formed in the legs 131. Cam grooves 135, which engaging pins (not shown) provided on a mating connector (not shown) engage, are formed in tip ends of the legs 131 of the lever 130.

When the lever 130 is located in the initial position, the wire cover 120 can be mounted on the housing 110 in the non-inverted orientation shown in FIG. 8A or in the inverted orientation shown in FIG. 8B. In cases where the wire cover 120 is mounted on the housing 110 in the non-inverted orientation, the wire cover 120 is brought to the second side of the housing 110, as shown in FIG. 8A. The wire cover 120 is then moved in a direction of the arrow so that the housing 110 is accommodated in the housing accommodating cavity 122. When the engaging projection member 112 that is provided on the upper surface side of the engaging projection members 112 of the housing 110 engages with the locking opening 124*a*, the housing 110 is locked inside the housing accommodating cavity 122. The electrical wire lead-out opening 123 of the wire cover 120 is disposed on the first side, so that electrical wires (not shown) are led out from the first side of the housing 110 from the electrical wire lead-out opening 123 in a bundled state.

When the wire cover 120 is mounted on the housing 110 in the inverted orientation, the two surfaces of the wire cover 120, i.e., the upper surface and undersurface, are inverted, and the wire cover 120 is brought to the first side of the housing 110, as shown in FIG. 8B. The wire cover 120 is then moved in a direction of the arrow in FIG. 8B, so that the housing 110 is accommodated in the housing accommodating cavity 122. When the engaging projection 112 that is provided on the undersurface side of the engaging projections 112 of the housing 110 engages with the locking opening 124*a*, the housing 110 is locked inside the housing accommodating cavity 122. The electrical wire lead-out opening 123 of the wire cover 120 is disposed on the second side, so that electrical wires (not shown) are led out from the second side of the housing 110 from the electrical wire lead-out opening 123 in a bundled state.

A mating connector (not shown) is then mated with the lever type connector 101 when the lever 130 is in the initial position. The lever 130 is then caused to pivot to the final position so that the engaging pins (not shown) provided on the mating connector (not shown) are drawn in along the cam grooves 135 in a mating direction. The mating operation of the mating connector (not shown) and lever type connector 101 is thus completed.

In the lever type connector 101 shown in FIGS. 8A–8B, since the wire cover 120 can be mounted on the housing 110 in the non-inverted orientation or inverted orientation, electrical wires (not shown) can be led out from either the second side or the first side of the housing 110 so that the degree of freedom in the wiring is increased, and the work of running electrical wires can be performed efficiently. However, because the housing 110 is accommodated inside the wire cover 120, and the lever 130 is mounted on an outside of the wire cover 120, there is a problem in that the size of the lever type connector 101 itself is large.

FIG. 9 shows an example of another a conventional lever type connector 201, which makes it possible to lead out electrical wires from either a first or second side of a housing while avoiding an increase in the size of the lever type connector 201 itself. As shown in FIG. 9, the lever type connector 201 comprises a housing 210 provided with contacts (not shown). A wire cover 220 is attached to the housing 210 and covers electrical wires (not shown) connected to the contacts (not shown). One side surface of the wire cover 220 has an electrical wire lead-out opening 221 for leading the electrical wires (not shown) out of the wire cover 120. A lever 230 is mounted on the housing 210 so that the lever 230 can pivot between an initial position and a final position. The lever 230 can be mounted either in an initial position where the lever 230 is pushed over toward the first side of the housing 210 or where the lever 230 is pushed over toward the second side of the housing 210. In FIG. 9, the lever 230 is pushed over toward the first side of the housing 210 in the initial position.

When the lever 230 is mounted in a direction in which the lever 230 is pushed over toward the first side of the housing 210 in the initial position, the wire cover 220 is designed to be locked with the housing 210 by sliding the wire cover 220 leftward in a direction of arrow A from the first side of the housing 210 with the electrical wire lead-out opening 221 in front. When the lever 230 is mounted in a direction in which this lever 230 is pushed over toward the second side of the housing 210 in the initial position, the wire cover 220 is designed to be locked with the housing 210 by sliding the wire cover 220 rightward from the second side of the housing 210 with the electrical wire lead-out opening 221 in front.

When the lever 230 is caused to pivot from the initial position to the final position, a mating connector (not shown) is moved in a mating direction (i.e., in the upward direction from the bottom in FIG. 9) as a result of this pivoting to mate the mating connector (not shown) with the lever type connector 201. When the lever 230 is located in the final position, a locking member (not shown) provided on the lever 230 is locked with a locking member 222 provided on an upper surface of the wire cover 220 so that the final position of the lever 230 is maintained.

In the lever type connector 201, the electrical wires (not shown) can be led out from either the second side or the first side of the housing 210 by the wire cover 220 that solely covers the electrical wires (not shown). Additionally, the lever 230 and the wire cover 220 are mounted on the housing 210. The size of the lever type connector 201 itself can therefore be reduced. However, in the lever type connector 201, when the lever 230 is mounted in a direction in which the lever 230 is pushed over toward the first side of the housing 210, in cases where the wire cover 220 is caused to slide rightward from the second side of the housing 210 with the electrical wire lead-out opening 221 in front, and in cases where the wire cover 220 is caused to slide leftward from the first side of the housing 210 with the side opposite from the side on which the electrical wire lead-out opening 221 is present in front, there is a danger that the wire cover 220 will still be locked with the housing 210. Additionally, when the lever 230 is mounted in a direction in which this lever 230 is pushed over toward the second side of the housing 210, even in cases where the wire cover 220 is caused to slide leftward from the first side of the housing with the electrical wire lead-out opening 221 in front, and in cases where the wire cover 220 is caused to slide rightward from the second side of the housing 210 with the side opposite from the side on which the electrical wire lead-out opening 221 is present in front, there is a danger that the wire cover 220 will still be locked with the housing 210.

In such cases, the mounting direction of the wire cover 220 becomes opposite of the originally intended direction, creating a problem in that the electrical wire lead-out direction ends up being opposite of the originally intended direction. When the mounting direction of the wire cover 220 becomes opposite of the mounting direction of the lever 230, the lever 230 is caused to pivot from the initial position to the final position and the lever 230 contacts the wire cover 220. The lever 230 therefore cannot pivot smoothly, and even if pivoting is possible, the lever 230 cannot be locked in the final position.

BRIEF SUMMARY OF THE INVENTION

It is therefore an object of the invention to provide a lever type connector which makes it possible to lead out electrical wires from either side of a housing without increasing the size of the connector itself while avoiding the danger that the wire cover will be locked to the housing in cases where the wire cover is mounted in an opposite direction.

This and other objects are achieved by a lever type connector comprising a housing provided with a plurality of contacts having electrical wires extending therefrom. A lever is mounted on the housing so that the lever is either pushed over toward a first side of the housing or a second side of the housing in an initial position. The lever is pivotable between the initial position and a final position. A wire cover is slideably mounted on the housing and has an electrical wire lead-out opening that leads the electrical wires away from the housing. The wire cover is slideable from the first side of the housing toward the second side of the housing with the electrical wire lead-out opening positioned closer toward the second side of the housing when the lever is pushed over toward the first side of the housing to lock the wire cover to the housing, and the wire cover is slideable from the second side of the housing toward the first side of the housing with the electrical wire lead-out opening positioned closer toward the first side of the housing when the lever is pushed over toward the second side of the housing in the initial position to lock the wire cover to the housing. A lock preventing member is provided on the lever type connector and is configured to prevent the wire cover from locking with the housing when the wire cover is not slid from the first side of the housing toward the second side of the housing with the electrical wire lead-out opening positioned closer toward the second side of the housing when the lever is pushed over toward the first side of the housing in the initial position and when the wire cover is not slid from the second side of the housing toward the first side of the housing with the electrical wire lead-out opening positioned closer toward the first side of the housing when the lever is pushed over toward the second side of the housing in the initial position.

This and other objects are further achieved by a lever type connector comprising a housing provided with a plurality of contacts having electrical wires extending there from. The housing has recessed rail members extending from a first side to a second side of the housing, the recessed rail members have first and second locking recesses. The first locking recesses are provided on the first side of the housing, and the second locking recesses are provided on the second side of the housing. A lever is mounted on the housing so that the lever is either pushed over toward the first side of the housing or the second side of the housing in an initial position. The lever is pivotable between the initial position and a final position. A wire cover has an electrical wire lead-out opening that leads the electrical wires away from the housing. The wire cover has sliding claws that are received in the recessed rail members to slideably mount the wire cover to the housing. The sliding claws have locking projections that engage either the first projections or the second projections to lock the wire cover to the housing. A lock preventing member is arranged between the first locking recesses and the second locking recesses and prevents the wire cover from being locked to the housing in an incorrect orientation.

DETAILED DESCRIPTION OF THE INVENTION

Figure 1:
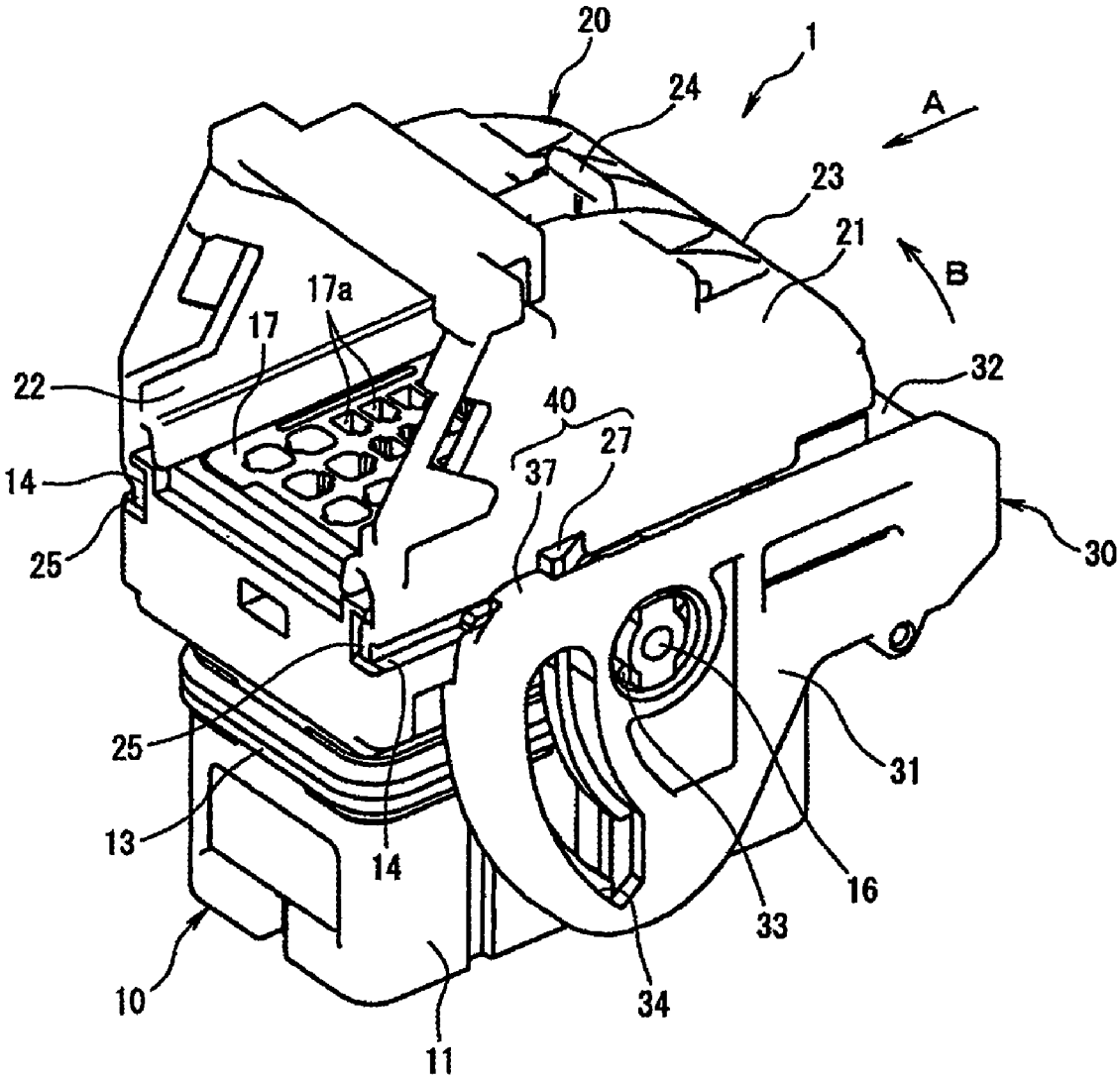
FIG. 1 is a perspective view of a lever type connector according to the invention shown with a wire cover and a lever pushed over to a first side of a housing of the lever type connector.
Figure 2:
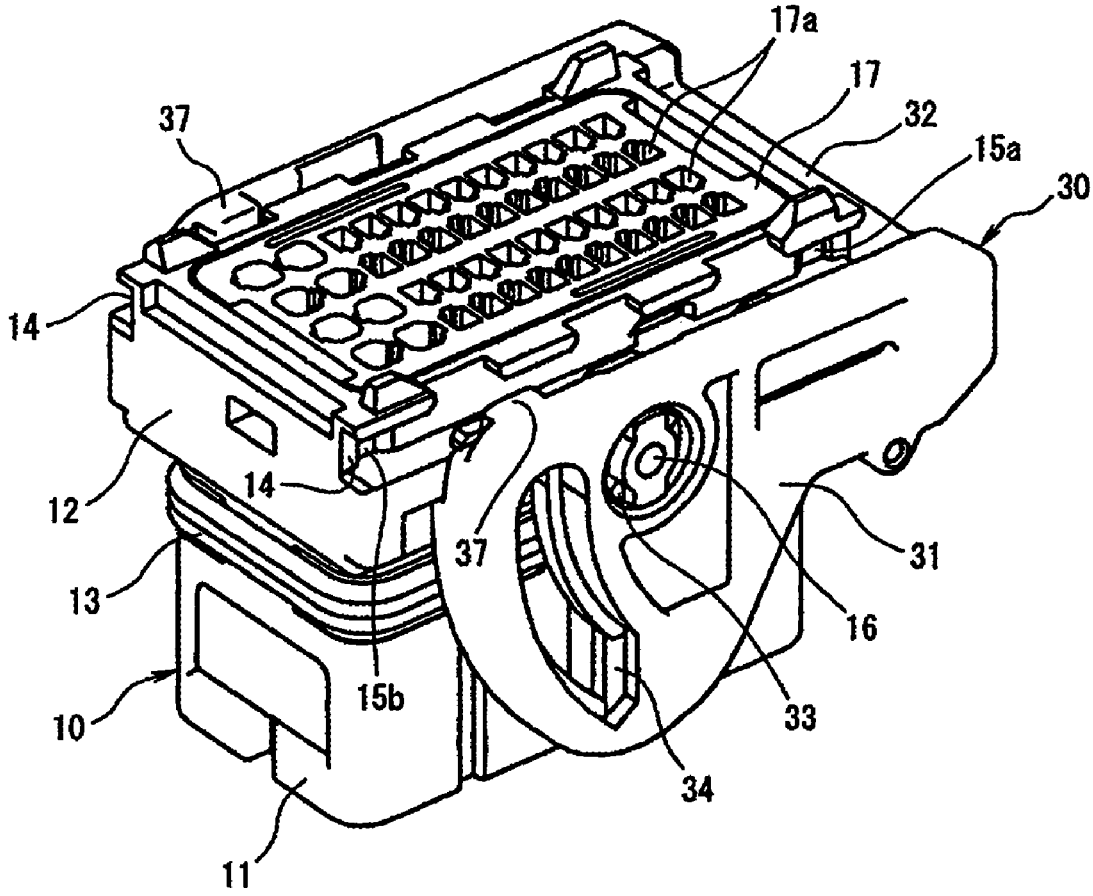
FIG. 2 is a perspective view of the lever type connector of FIG. 1 shown without the wire cover.

FIGS. 1–4 show a lever type connector 1 according to the invention. As shown in FIGS. 1–4, the lever type connector 1 comprises a housing 10, a wire cover 20, and a lever 30. The housing 10 may be formed, for example, by molding an insulating resin. The housing 10 includes a mating portion 11, which accommodates a plurality of contacts (not shown). The mating portion 11 is substantially rectangular in shape and is configured for mating with a mating connector (not shown) from a bottom of the housing 10. A waterproof seal 13 is attached to a circumference of the mating portion 11. As shown in FIG. 2, a substantially rectangular seal accommodating member 12 is provided above the mating portion 11. A sealing member 17 is accommodated inside the seal accommodating member 12. The sealing member 17 has a plurality of through through-openings 17*a*. Electrical wires (not shown) connected to the contacts (not shown) in the mating portion 11 are led out of a top of the housing 10 by passing through the through-openings 17*a* formed in the sealing member 17. The electrical wires (not shown) are thereby sealed by the sealing member 17.

Opposing side walls of the seal accommodating member 12 are formed with recessed rail members 14 that extend in a left-right direction. First and second locking recesses 15*a*, 15*b* are formed in a surface of each of the side walls in each of the rail members 14. The first and second locking recesses 15*a*, 15*b* are in positions separated from each other by a specified distance in the left-right direction. The first locking recesses 15*a* are formed in a vicinity of right end portions of the side walls, and the second locking recesses 15*b* are formed in a vicinity of left end portions of the side walls. A lever supporting shaft 16 is provided on each side wall of the seal accommodating member 12 substantially beneath the rail members 14. First and second holding recessed members (not shown) are formed in each of the surfaces of the side walls of the seal accommodating member 12 of the housing 10 in positions separated from each other by a specified distance in the left-right direction.

Figure 6:
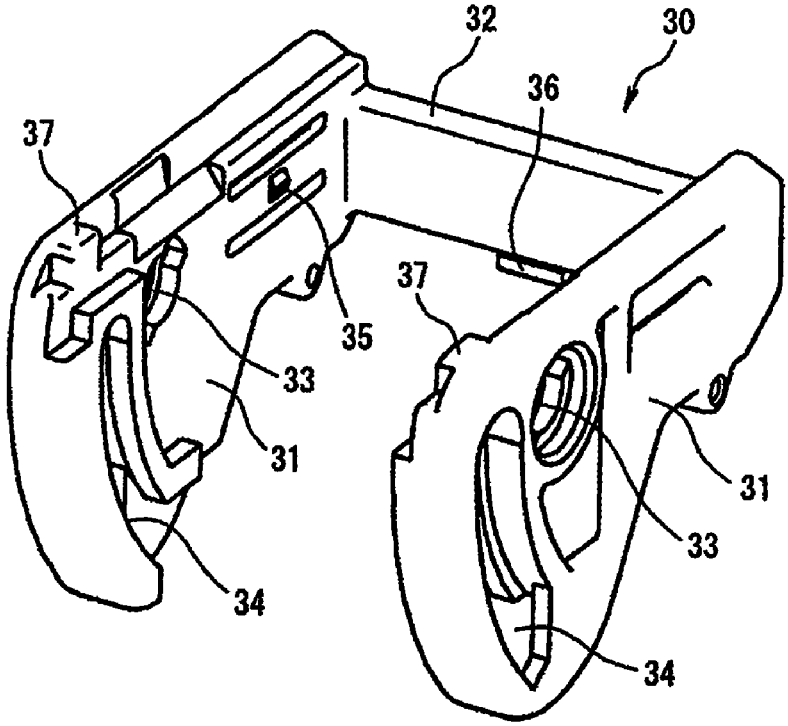
FIG. 6 is a perspective view of a lever.

The lever 30 is attached to the housing 10 in a pivotable manner such that the lever 30 can rotate between an initial position and a final position. The lever 30 is pivotable about 90 degrees from the initial position to the final position. The lever 30 is formed, for example, by molding an insulating resin. As shown in FIG. 6, the lever 30 is substantially U-shaped and comprises a pair of legs 31. The legs 31 are joined by a linking member 32 provided at an end thereof. Cam grooves 34 configured for engagement with engaging pins (not shown) provided on the mating connector (not shown) are formed in the legs 31 on a side opposite from the side of the linking member 32. Attachment openings 33 are formed in the legs 31 between the cam grooves 34 and the linking member 32. Engaging projections 35 are provided on inner surfaces of the legs 31 of the lever 30. A locking member 36 is provided on the linking member 32.

Figure 3:
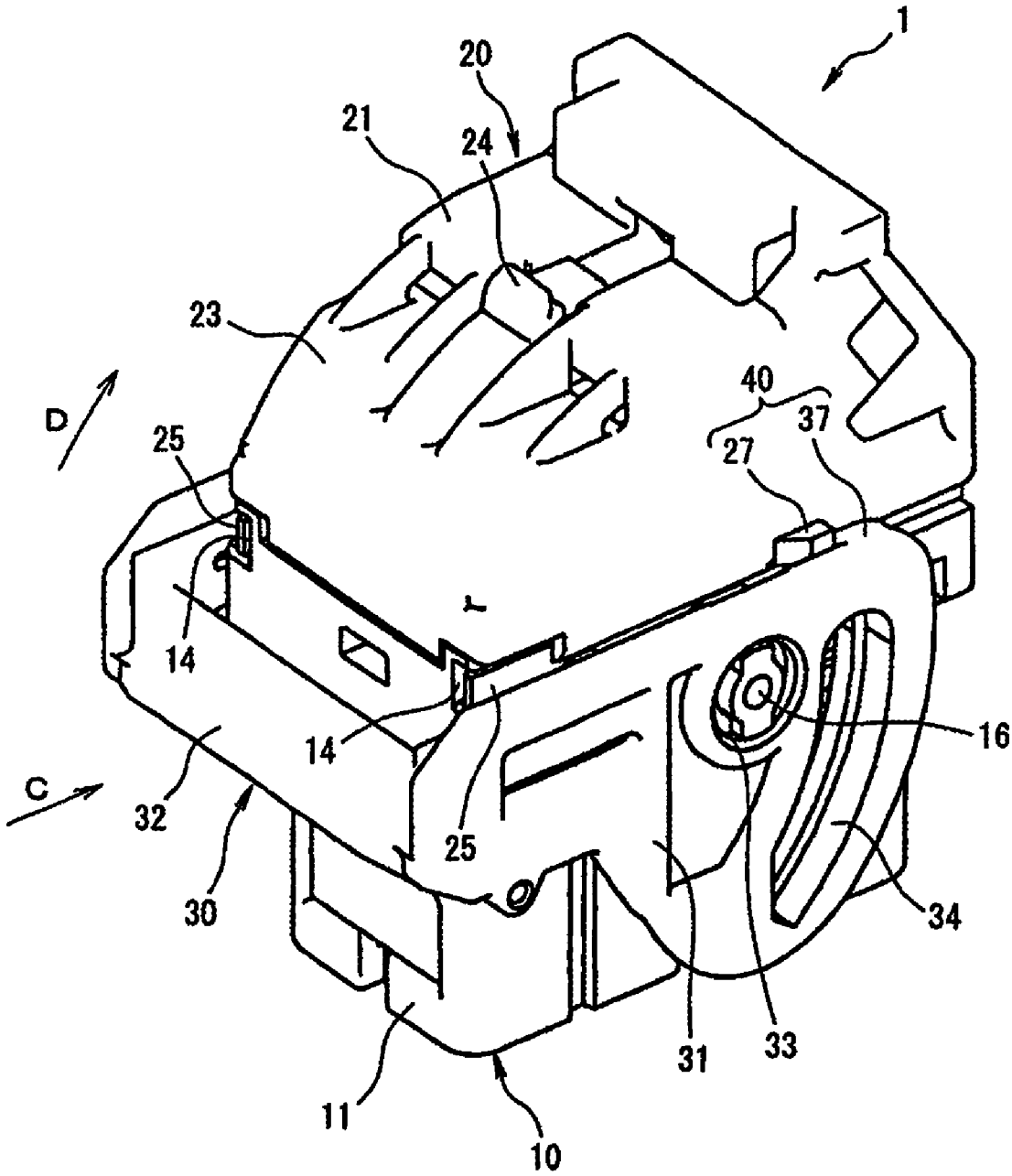
FIG. 3 is a perspective view of a second side of the lever type connector according to the invention shown with the wire cover and the lever pushed over to a second side of the housing of the lever type connector.
Figure 4:
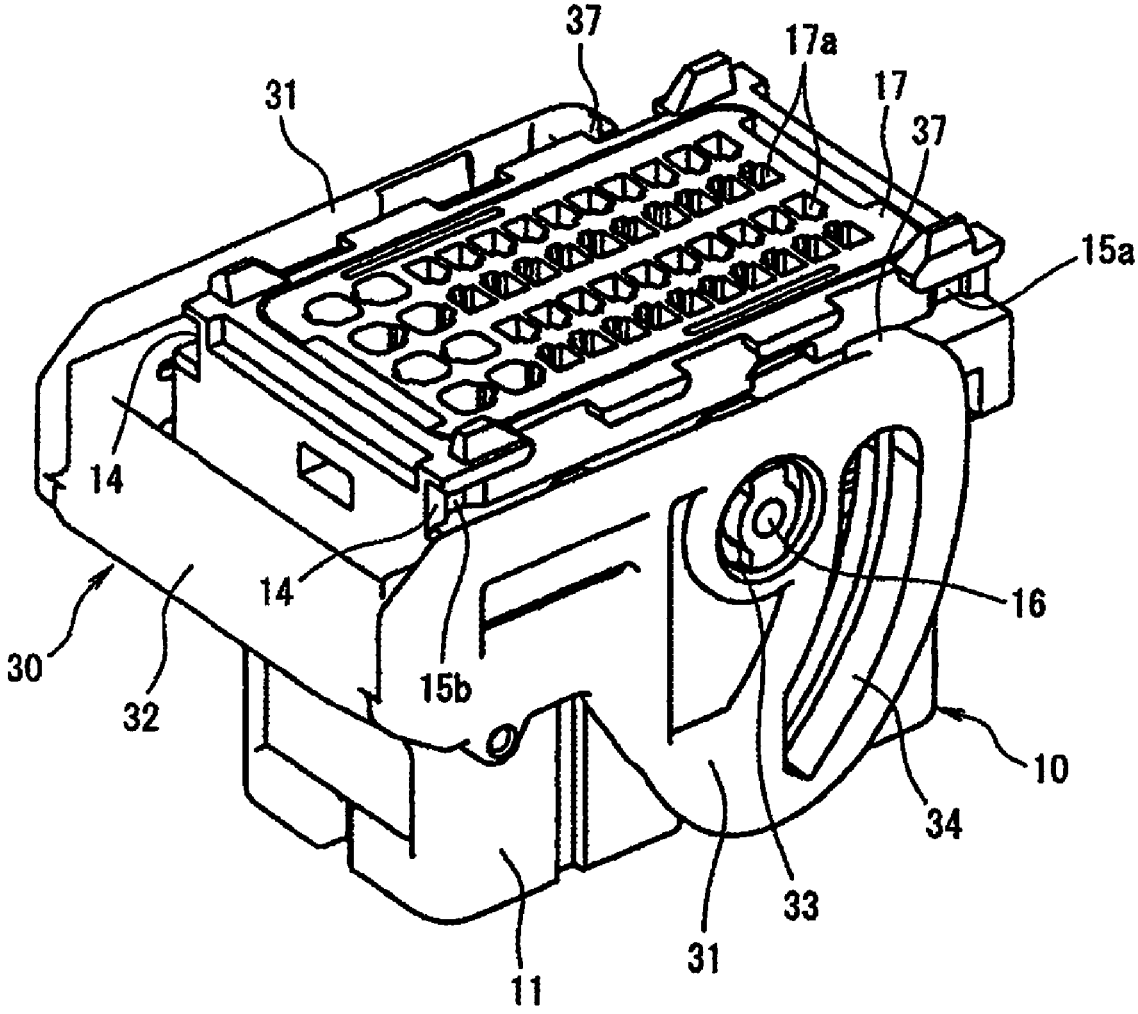
FIG. 4 is a perspective view of the lever type connector of FIG. 3 shown without the wire cover.

The lever 30 is mounted in a pivotable manner as a result of the attachment openings 33 being respectively fitted over the supporting shafts 16 of the housing 10. In the initial position, the lever 30 can be mounted either in a direction in which the lever 30 is positioned on a first side of the housing 10 (right side in FIGS. 1–2), as shown in FIGS. 1–2, or in a direction in which the lever 30 is positioned on a second side of the housing 10 (left side in FIGS. 3–4), as shown in FIGS. 3–4. The engaging projections 35 are designed so that when the lever 30 is in the initial position and is mounted in the direction in which the lever 30 is pushed over to the first side of the housing 10, the engaging projections 35 respectively engage with the first holding recessed members (not shown) on the first side of the housing 10 to maintain this initial position. When the lever 30 is in the initial position and is mounted in the direction in which the lever 30 is pushed over to the second side of the housing 10, the engaging projections 35 respectively engage with the second holding recessed members (not shown) on the second side of the housing 10 to maintain this initial position. When the lever 30 is in the final position, the locking member 36 is designed to hold the final position by engaging with a locking piece 24 (FIGS. 1 and 3) provided on the wire cover 20.

Figure 5:
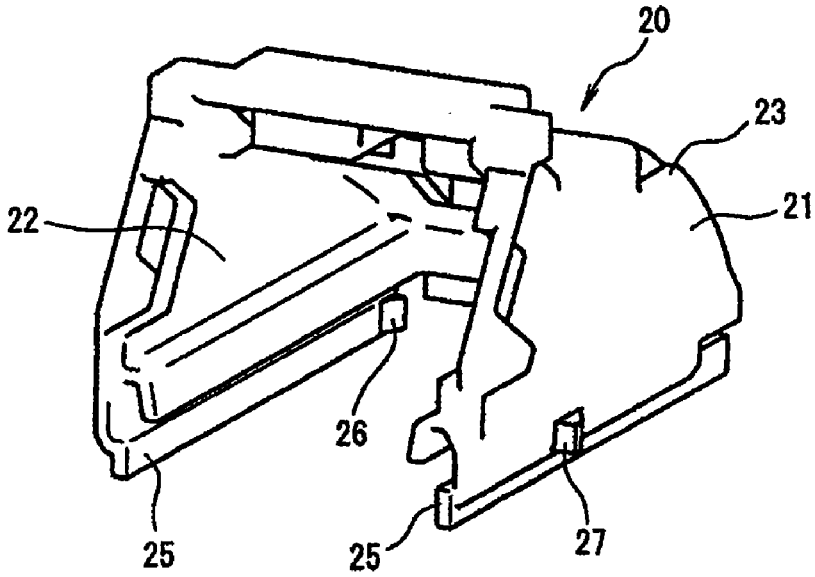
FIG. 5 is a perspective view of the wire cover.

The wire cover 20 is formed, for example, by molding an insulating resin. As shown in FIG. 5, the wire cover comprises a cover main body 21. The cover main body 21 has an upper curved surface 23 and an open lower surface. The cover main body 21 is configured to substantially cover the electrical wires (not shown) that are connected to the contacts (not shown). An electrical wire lead-out opening 22 is formed on a side surface of the cover main body 21. The electrical wires (not shown) covered by the cover main body 21 are designed to be led out to an outside of the housing 10 from the electrical wire lead-out opening 22. As shown in FIG. 3, the locking piece 24 is provided on the upper curved surface 23 of the cover main body 21. The locking piece 24 is formed such that it can undergo elastic deformation when the locking member 36 of the lever 30 engages the locking piece 24. As shown in FIG. 5, each side wall of the cover main body 21 is provided with a sliding claw 25 that extends in the left-right direction and is fitted into the rail members 14 of the housing 10. Locking projections 26 are provided on right end portions of inner surfaces of the respective sliding claws 25 (only one of the locking projections 26 is shown in FIG. 5).

When the lever 30 is mounted in a direction in which the lever 30 is pushed over to the first side of the housing 10 in the initial position, as shown in FIGS. 1–2, the wire cover 20 is caused to slide leftward in a direction of arrow A from the first side of the housing 10. In this position, the electrical wire lead-out opening 22 is in the front, as shown in FIG. 1. The sliding claws 25 of the wire cover 20 are respectively fitted into the rail members 14 of the housing 10 and are caused to slide leftward from the first side. As a result of the locking projections 26 provided on the sliding claws 25 respectively entering the first locking recesses 15*a* formed in the housing 10, the wire cover 20 is locked to the housing 10.

On the other hand, when the lever 30 is mounted in a direction in which the lever 30 is pushed over to the second side of the housing 10 in the initial position, as shown in FIGS. 3–4, the wire cover 20 is caused to slide rightward in a direction of arrow C from the second side of the housing 10. In this position, the electrical wire lead-out opening 22 is in the front, as shown in FIG. 3. The sliding claws 25 of the wire cover 20 are respectively fitted into the rail members 14 of the housing 10 and are caused to slide rightward from the second side. As a result of the locking projections 26 provided on the sliding claws 25 respectively entering the second locking recesses 15*b* formed in the housing 10, the wire cover 20 is locked to the housing 10.

The lever 30 can therefore be mounted in the initial position either in a direction in which the lever 30 is pushed over to the first side of the housing 10 or in a direction in which the lever 30 is pushed over to the second side of the housing 10. Accordingly, the electrical wires (not shown) can be led out from either the first side or second side of the housing 10. Moreover, because the lever 30 and the wire cover 20 are mounted on the housing 10 and the shape of the wire cover 20 is such that it covers the electrical wires (not shown) and leads out the electrical wires (not shown), it is possible to avoid an increase in the size of the lever type connector 1.

Figure 7:
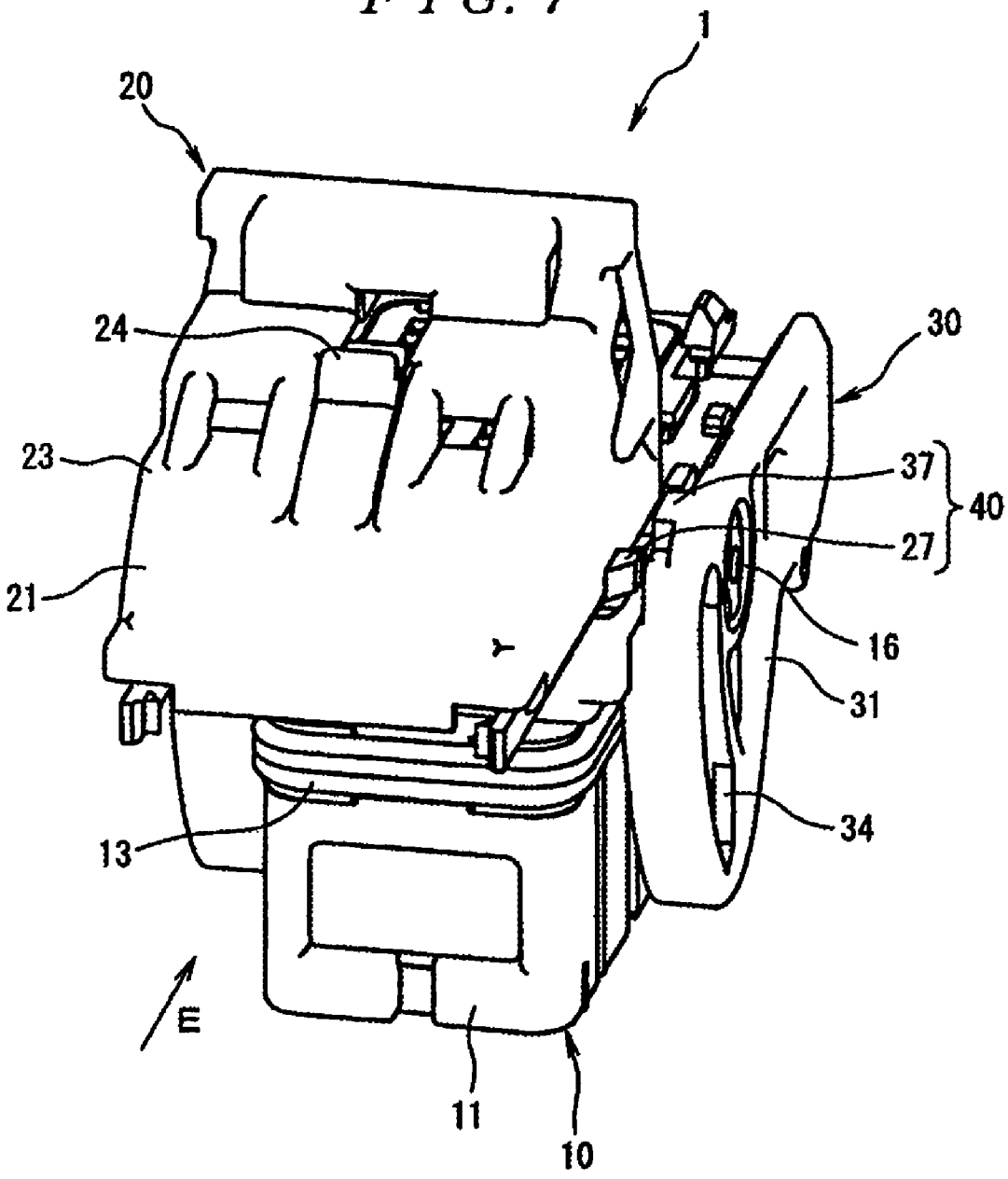
FIG. 7 is a perspective view of the lever type connector according to the invention showing the attachment of the wire cover to the housing.
Figure 8A:
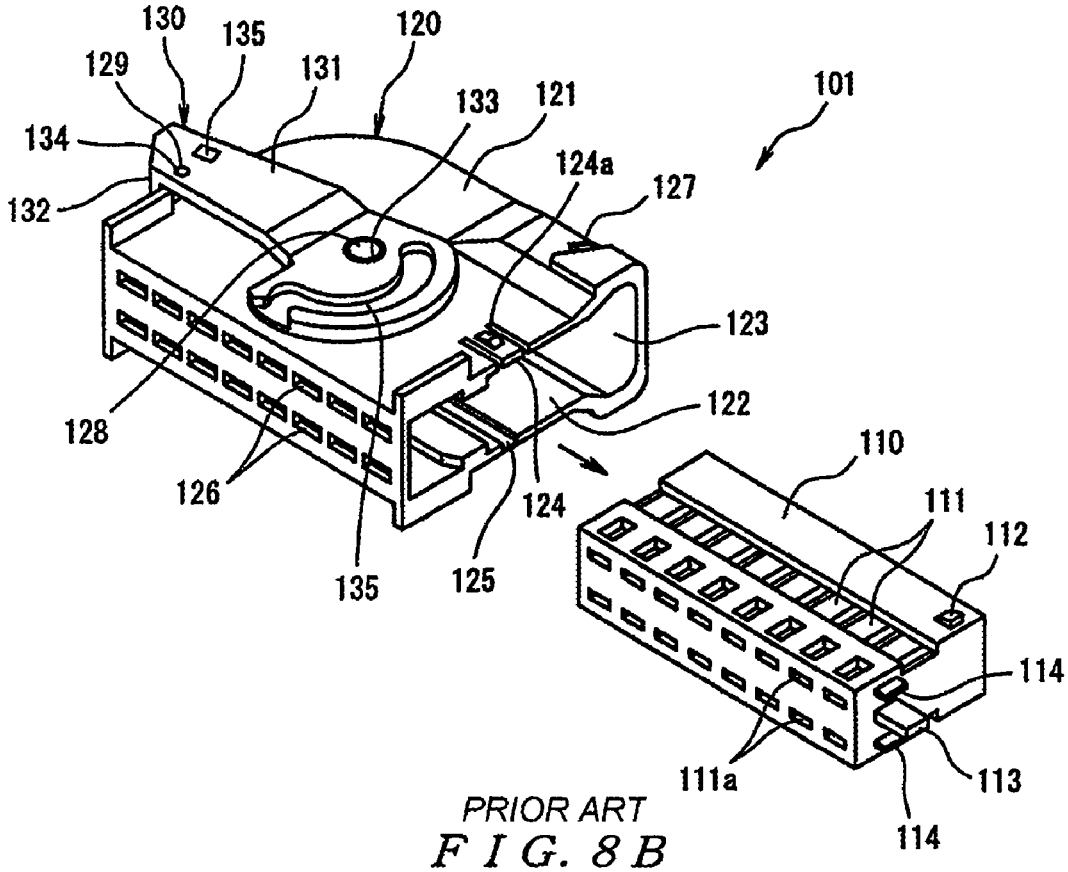
PRIOR ART FIG. 8A
FIG. 8A is an exploded perspective view of a lever type connector according to the prior art shown with a wire cover mounted on a housing of the lever type connector in a non-inverted orientation.
Figure 8B:
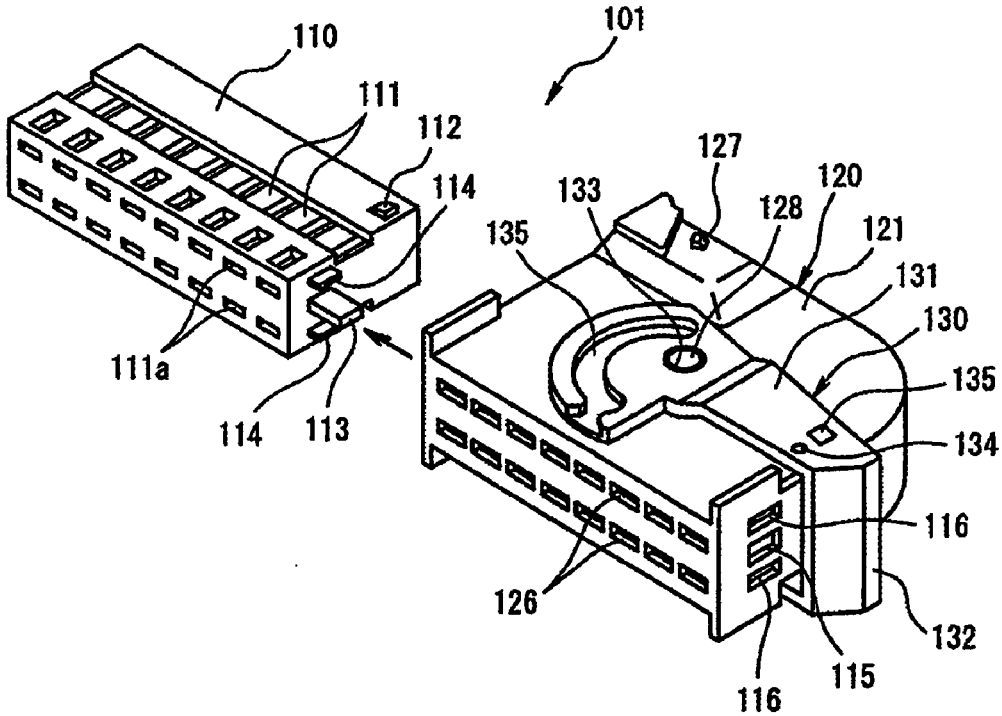
PRIOR ART FIG. 8B
FIG. 8B is an exploded perspective view of the lever type connector of FIG. 8A shown with the wire cover mounted on the housing of the lever type connector in an inverted orientation.
Figure 9:
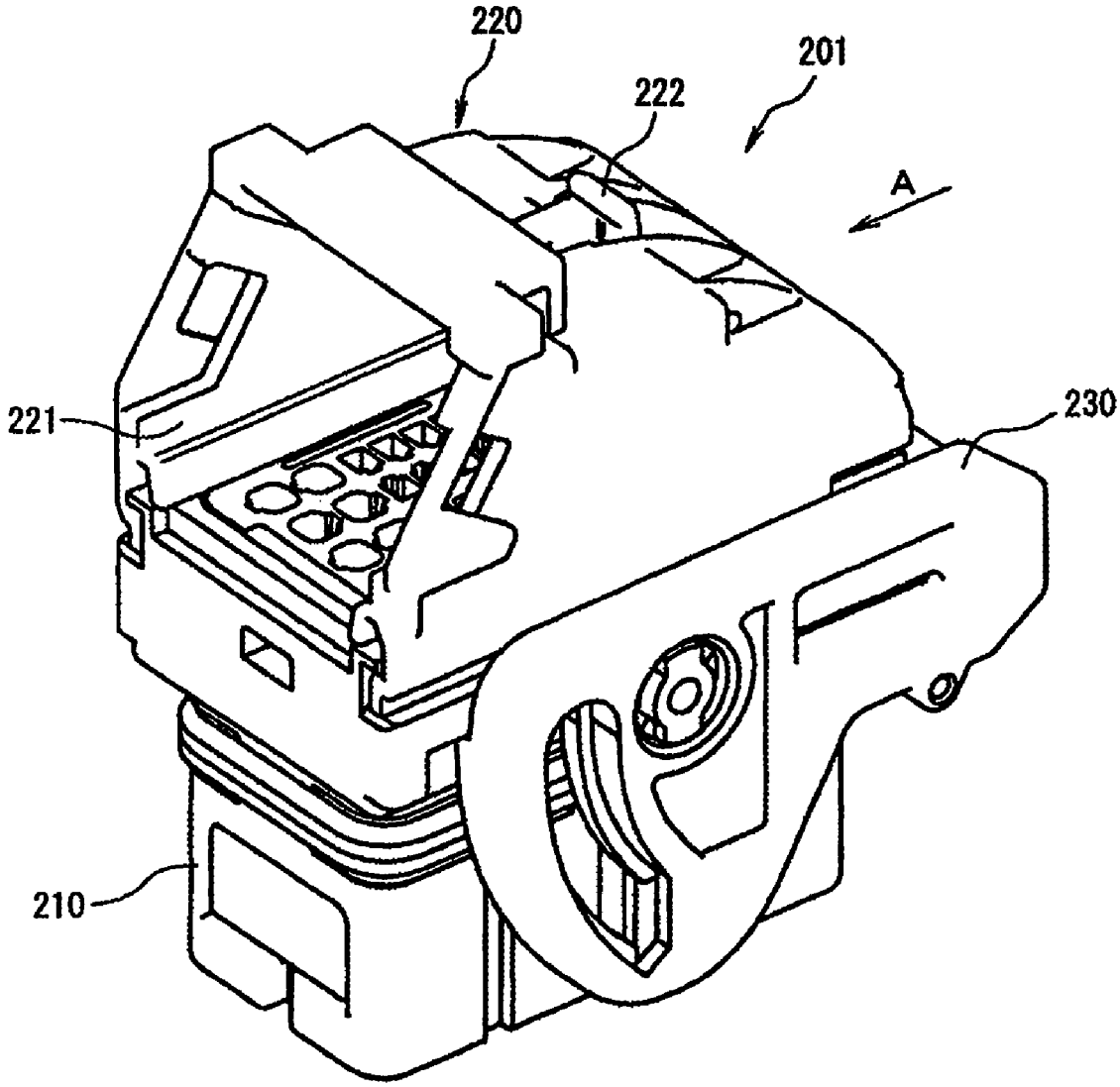
PRIOR ART FIG. 9
FIG. 9 is a perspective view of another lever type connector according to the prior art.

When the lever 30 is mounted in a direction in which the lever 30 is pushed over to the first side of the housing 10, as shown in FIG. 2, there are cases in which the wire cover 20 is caused to slide rightward in a direction of arrow E from the second side of the housing 10 with the electrical wire lead-out opening 22 in front as shown in FIG. 7, or cases in which the wire cover 20 is caused to slide leftward from the first side of the housing 10 with the side opposite from the wire lead-out opening 22 in front (not shown). In these cases, if the locking projections 26 provided on the sliding claws 25 enter the second locking recesses 15*b*, and are thus locked, the mounting direction of the wire cover 20 becomes opposite of the originally intended direction, so that there is a problem in that the electrical wire lead-out direction ends up being opposite of the originally intended direction.

When the lever 30 is mounted in a direction in which the lever 30 is pushed over to the second side of the housing 10, as shown in FIG. 4, there are also cases in which the wire cover 20 is caused to slide leftward from the first side of the housing 10 with the electrical wire lead-out opening 22 in front (not shown), or cases in which the wire cover 20 is caused to slide rightward from the second side of the housing 10 with the side opposite from the wire lead-out opening 22 in front. In these cases, if the locking projections 26 provided on the sliding claws 25 enter the first locking recesses 15*a*, and are thus locked, the mounting direction of the wire cover 20 becomes opposite of the originally intended direction, so that there is a problem in that the electrical wire lead-out direction ends up being opposite of the originally intended direction.

In order to avoid these problems, the lever type connector 1 includes a lock preventing member 40, as shown in FIG. 7. The lock preventing member 40 includes a pair of first and second projections 37, 27, respectively. The first projections 37 extend from the legs 31 of the lever 20. The first projections 37 are formed on upper end portions of the inner surfaces of the legs 31 so that the first projections 37 face the rail members 14 of the housing 10 in a direction of height when the lever 30 is located in the initial position shown in FIGS. 1–4. The second projections 27 extend from the wire cover 20 and are configured to contact the first projections 37. The second projections 27 are formed to protrude from the side walls of the cover main body 21 so that the second projections 27 are located in positions more or less at the same height as that of the first projections 37 in the direction of height when the wire cover 20 is mounted and caused to slide.

The first projections 37 and the second projections 27 are positioned in the left-right direction such that when the second projections 27 contact the first projections 37, it is possible to prevent the locking projections 26 provided on the sliding claws 25 from entering the second locking recesses 15*b* and being locked therewith when the lever 30 is mounted in a direction in which the lever 30 is pushed over toward the first side of the housing 10, in cases where the wire cover 20 is caused to slide rightward in the direction of arrow E from the second side of the housing 10 with the electrical wire lead-out opening 22 in front as shown in FIG. 7, and in cases where the wire cover 20 is caused to slide leftward from the first side of the housing 10 with the side opposite from the side where the electrical wire lead-out opening 22 is present in front. In addition, the first projections 37 and the second projections 27 are positioned in the left-right direction such that when the second projections 27 contacting the respective first projections 37, it is possible to prevent the locking projections 26 provided on the sliding claws 25 from entering the first locking recesses 15*a* and being locked therewith when the lever 30 is mounted in a direction in which this lever 30 is pushed over toward the second side of the housing 10, in cases where the wire cover 20 is caused to slide leftward from the first side of the housing 10 with the electrical wire lead-out opening 22 in front, and in cases where the wire cover 20 is caused to slide rightward from the second side of the housing 10 with the side opposite from the side where the electrical wire lead-out opening 22 is present in front.

In cases where the wire cover 20 is mounted on the housing 10 in the opposite direction, it is therefore possible to avoid locking the wire cover 20 with the housing 10 as a result of the locking projections 26 provided on the sliding claws 25 entering the second locking recesses 15*b* and being locked therewith or as a result of the locking projections 26 entering the first locking recesses 15*a* and being locked therewith. Accordingly, there is no possibility of the mounting orientation of the wire cover 20 becoming opposite of the originally intended direction, so that there is no possibility of the electrical wire lead-out direction becoming opposite of the originally intended direction.

The method of mating the lever type connector 1 with the mating connector (not shown) will now be described. As shown in FIG. 1, in a state in which the lever 30 is mounted in a direction in which the lever 30 is pushed over toward the first side of the housing 10 in the initial position, and the wire cover 20 is locked with the housing 10 by sliding this wire cover 20 leftward from the first side of the housing 10 with the electrical wire lead-out opening 22 in front, the mating connector (not shown) is mated with the mating portion 11 from the bottom of the housing 10. The lever 30 is pivoted from the initial position in a direction of arrow B in FIG. 1. Engaging pins (not shown) of the mating connector (not shown) are thereby drawn in along the cam grooves 34 in a mating direction (upward from the bottom in FIG. 1), and the mating connector (not shown) moves in the mating direction. The lever 30 is pivoted further in the direction of the arrow B until the lever 30 is located in the final position. When the lever 30 is located in the final position, the locking member 36 provided on the lever 30 engages with the locking piece 24 provided on the upper surface of the wire cover 20 and is thus locked thereto. As a result, the mating of the mating connector (not shown) with the lever type connector 1 is completed.

As shown in FIG. 3, in a state in which the lever 30 is mounted in a direction in which the lever 30 is pushed over toward the second side of the housing 10 in the initial position, and the wire cover 20 is locked with the housing 10 by sliding the wire cover 20 rightward from the second side of the housing 10 with the electrical wire lead-out opening 22 in front, the mating connector (not shown) is mated with the mating portion 11 from the bottom of the housing 10. The lever 30 is pivoted from the initial position in the direction of arrow D in FIG. 3. The engaging pins (not shown) of the mating connector (not shown) are drawn in along the cam grooves 34 in a mating direction (upward from the bottom in FIG. 3), and the mating connector (not shown) moves in the mating direction. The lever 30 is pivoted further in the direction of the arrow D until the lever 30 is located in the final position. When the lever 30 is located in the final position, the locking member 36 provided on the lever 30 engages with the locking piece 24 provided on the upper surface of the wire cover 20 and is thus locked thereto. As a result, the mating of the mating connector (not shown) with the lever type connector 1 is completed.

Further, by providing the lock preventing member 40 on the lever 30 and the wire cover 20, in cases where the wire cover 20 is mounted on the housing 10 in the opposite direction, the locking of the wire cover 20 with the housing 10 can be avoided, so that the mounting direction of the wire cover 20 does not become opposite of the mounting direction of the lever 30. Accordingly, when the lever 30 is caused to pivot from the initial position to the final position, the problem of the lever 30 contacting the wire cover 20 can be avoided, and the problem of the lever 30 not being able to lock in the final position can also be avoided.

The foregoing illustrates some of the possibilities for practicing the invention. Many other embodiments are possible within the scope and spirit of the invention. For example, it is not necessary to construct the lock preventing member 40 from a pair of first projections 37 provided on the legs 31 and a pair of second projections 27 provided on the wire cover 20. Other possible methods for forming the lock prevented member 40 are possible, as long as the lock preventing member 40 prevents the locking of the wire cover 20 with the housing 10 so that incorrect mounting of the wire cover 20 on the housing 10 is prevented. It is, therefore, intended that the foregoing description be regarded as illustrative rather than limiting, and that the scope of the invention is given by the appended claims together with their full range of equivalents.

What is claimed is:

1. A lever type connector, comprising:

a housing provided with a plurality of contacts having electrical wires extending therefrom;

a lever mounted on the housing so that the lever is either pushed over toward a first side of the housing or a second side of the housing in an initial position, the lever being pivotable between the initial position and a final position;

a wire cover slideably mounted on the housing, the wire cover having an electrical wire lead-out opening that leads the electrical wires away from the housing, the wire cover being slideable from the first side of the housing toward the second side of the housing with the electrical wire lead-out opening being positioned closer toward the second side of the housing when the lever is pushed over toward the first side of the housing to lock the wire cover to the housing and the wire cover being slideable from the second side of the housing toward the first side of the housing with the electrical wire lead-out opening being positioned closer toward the first side of the housing when the lever is pushed over toward the second side of the housing in the initial position to lock the wire cover to the housing; and a lock preventing member provided on the lever type connector and configured to prevent the wire cover from locking with the housing when the wire cover is not slid from the first side of the housing toward the second side of the housing with the electrical wire lead-out opening being positioned closer toward the second side of the housing when the lever is pushed over toward the first side of the housing in the initial position and when the wire cover is not slid from the second side of the housing toward the first side of the housing with the electrical wire lead-out opening being positioned closer toward the first side of the housing when the lever is pushed over toward the second side of the housing in the initial position;

wherein the lock preventing member includes a first projection extending from the lever and a second projection extending from the wire cover such that the first projection engages the second projection to prevent the wire cover from locking with the housing.

2. The lever type connector of claim 1, wherein the lever includes a locking member that engages a locking piece on the wire cover in the final position.

3. The lever type connector of claim 1, wherein the lever is pivotable about 90 degrees from the initial position to the final position.

4. The lever type connector of claim 1, wherein the lever is substantially U-shaped.

5. The lever type connector of claim 1, wherein the wire cover comprises a cover main body having an upper curved surface, an open lower surface, and a side surface provided with the electrical wire lead-out opening.

6. The lever type connector of claim 1, wherein the housing has recessed rail members and the wire cover has sliding claws that are received in the recessed rail members to slideably mount the wire cover to the housing.

7. The lever type connector of claim 6, wherein the recessed rail members have locking recesses and the sliding claws have locking projections that engage the locking recesses to lock the wire cover to the housing.

8. The lever type connector of claim 7, wherein the locking recesses include first and second locking recesses, the first locking recesses arranged on the first side of the housing and the second locking recesses arranged on the second side of the housing.

9. The lever type connector of claim 8, wherein the lock preventing member is arranged between the first locking recesses and the second locking recesses.

10. The lever type connector of claim 1, wherein the housing includes a mating portion for mating with a mating connector, the wire cover being slideable substantially perpendicular to a direction of mating with the mating connector.

11. A lever type connector, comprising:

a housing provided with a plurality of contacts having electrical wires extending there from, the housing having recessed rail members extending between a first and second side of the housing, the recessed rail members having first and second locking recesses, the first locking recesses being provided on the first side of the housing and the second locking recesses being provided on the second side of the housing;

a lever mounted on the housing so that the lever is either pushed over toward the first side of the housing or the second side of the housing in an initial position, the lever being pivotable between the initial position and a final position;

a wire cover having an electrical wire lead-out opening that leads the electrical wires away from the housing, the wire cover having sliding claws that are received in the recessed rail members to slideably mount the wire cover to the housing, the sliding claws having locking projections that engage either the first projections or the second projections to lock the wire cover to the housing; and a lock preventing member arranged between the first locking recesses and the second locking recesses that prevents the wire cover from being locked to the housing in an incorrect orientation;

wherein the lock preventing member includes a first projection extending from the lever and a second projection extending from the wire cover such that the first projection engages the second projection to prevent the wire cover from locking with the housing.

12. The lever type connector of claim 11, wherein the lever includes a locking member that engages a locking piece on the wire cover in the final position.

13. The lever type connector of claim 11, wherein the lever is pivotable about 90 degrees from the initial position to the final position.

14. The lever type connector of claim 11, wherein the lever is substantially U-shaped.

15. The lever type connector of claim 11, wherein the wire cover comprises a cover main body having an upper curved surface, an open lower surface, and a side surface provided with the electrical wire lead-out opening.

16. The lever type connector of claim 11, wherein the housing includes a mating portion for mating with a mating connector, the wire cover being slideable substantially perpendicular to a direction of mating with the mating connector.

17. The lever type connector of claim 11, wherein the wire lead-out opening is positioned to lead the electrical wires away from either the first side or the second side of the housing.

* * * * *